US005179775A

United States Patent [19]

Bogotzek et al.

[11] Patent Number: 5,179,775

[45] Date of Patent: Jan. 19, 1993

[54] SYSTEM FOR FINISHING CONDUCTOR BUNDLES

[75] Inventors: Hans Bogotzek, Nottensdorf; Hans-Peter Mairose, Borstel; Erich Orth, Hamburg, all of Fed. Rep. of Germany

[73] Assignee: Deutsche Airbus GmbH, Hamburg, Fed. Rep. of Germany

[21] Appl. No.: 819,459

[22] Filed: Jan. 10, 1992

[30] Foreign Application Priority Data

Jan. 12, 1991 [DE] Fed. Rep. of Germany ..... 4100797

[51] Int. Cl.[5] ..... H01R 43/04

[52] U.S. Cl. ..... 29/564.4; 29/33 M; 29/748

[58] Field of Search ..... 29/564.4, 564.1, 564.6, 29/748, 753, 605, 747, 33 M, 742, 564, 564.2, 33 K, 868; 140/92.2; 242/79

[56] References Cited

U.S. PATENT DOCUMENTS

| | | | |
|---|---|---|---|
| 3,706,122 | 12/1972 | La Valle | 29/742 X |
| 4,247,980 | 2/1981 | Tominol | 29/564.4 |
| 4,373,261 | 2/1983 | Long, Jr. | 29/564.6 |
| 4,383,559 | 5/1983 | Kling | 140/92.2 |
| 4,608,746 | 9/1986 | Csakvary | 29/564.4 |
| 4,638,558 | 1/1987 | Eaton | 29/753 X |
| 4,653,159 | 3/1987 | Henderson et al. | 29/33 M |
| 4,677,734 | 7/1987 | Bloch et al. | 29/564.2 |
| 4,729,152 | 3/1988 | Hammond | 29/564.6 |

*Primary Examiner*—William Briggs
*Attorney, Agent, or Firm*—W. G. Fasse

[57] ABSTRACT

A semi-automatic system for finishing a conductor wire harness permits an operator to secure contact elements to ends of conductor wires in a bundle and to insert secured contact elements into a connnector member in a computer aided manner. For this purpose the system has at least one desk type work station for an operator and a harness carrier for holding at least one conductor harness that was assembled, but not finished on a form board. The harness carrier is constructed as a platform for supporting the semifinished conductor harness. The platform is mounted on a movable support in a rotatable manner and for transporting the platform along a factory floor into a position for cooperation with the work station which includes an insulation stripper, a combined contact attachment device and crimper, a connector member clamping device, and a guide beam generator, all of which are computer controlled.

15 Claims, 3 Drawing Sheets

SYSTEM FOR FINISHING CONDUCTOR BUNDLES

FIELD OF THE INVENTION

The invention relates to a system for finishing conductor bundles to form conductor wire harnesses. Each harness comprises a plurality of wires, the ends of which are connected to a connector member usually of the male or female plug-in type.

BACKGROUND INFORMATION

Conductor wire harnesses of the type mentioned above are, for example, used in the electrical wiring of an aircraft to complete such wiring in accordance with standardized work procedures. The formation of the conductor wire harness normally involves, among others, the following work steps. Measuring the lengths of individual conductor wires, the arrangement of wires relative to each other, the insertion of the wires into sleeves or protective jackets, the securing of individual contact elements such as contact pins or contact bushings to the respective individual wire end after its insulation has been removed, the securing of the just mentioned contact elements in a connector member or in cable terminals, the binding or tie wrapping of harness branches, the insertion of vacant contacts and dummy plugs, the removal of the finished harness from the harness carrier, the rolling up of the finished harness and its packaging. Conventionally, all of the foregoing steps are performed while a conductor bundle or harness is being formed on a harness form board. It has been found that performing all of the above steps on one and the same form board is not efficient even in a fully automated operation, especially when the harness has a substantial length because in that case the form board must have a corresponding length, whereby it becomes cumbersome to handle such large form boards having a length of up to 30 meters.

Another disadvantage of performing all the harness completion steps on the same form board is seen in that the latter remains unavailable for prolonged periods of time for the formation of other conductor wire harnesses. As a result, it is necessary to provide a substantial number of large form boards in order to assure a trouble-free manufacturing sequence. Still another disadvantage of the large size form boards is seen in that they require a substantial factory floor space which is not justified by the actual size of the harnesses formed. Thus, there is room for improvement with regard to the efficient use of such form boards.

There are also known in the art tools including automatic tools for the performance of most of the above mentioned work steps. Such tools include automatic crimping devices and automatic insulation removing devices. However, these automatic tools and robots do not change the basic conventional situation which requires a substantial floor space for the harness formation, even if a form board remains on a roller conveyor for cooperation with a fully automatic harness producing robot system.

U.S. Pat. No. 4,677,734 (Bloch et al.) discloses a robot wire harness assembly system in which the harness is fabricated substantially automatically. Such a system includes computer controlled components such as a wire reeling subsystem, a wire terminating subsystem, a wire queuing subsystem, a lay-up subsystem, and the logic computer controller. Bloch et al. utilizes as a harness carrier a form board (115) which has a rectangular configuration and is movable on a roller conveyor of substantial size. The robotic components extend across the roller conveyor in gantry or cantilever fashion so that the form board or harness carrier can pass through the work stations from one end of the roller conveyor to the other and back again. The so-called "lay-up robot" uses a variety of tools and completes all required operations including the tie wrapping. The just described conventional system requires an extraordinary large floor space. This is so, especially when long harnesses are to be made. Harnesses for aircraft electrical wiring may in fact have a total length within the range of 20 to 30 meters. Accordingly, the form board (115) of Bloch et al. would have to have a length within this range. Thus, the width of the roller conveyor would have to correspond to the substantial lengths of the form board. The lengths of the roller conveyor extending perpendicularly to the lengths of the form board is also substantial to provide space for all tools thereby requiring an extaordinarily large floor space.

Further, there is no possibility of reducing the floor space for a system according to Bloch because in order to achieve the required precision, especially with regard to accurate lengths of the individual wires of the conductor wire harness, it is necessary to assemble the individual wires into the harness in their true actual shape or configuration. As a result, the dimension, especially the longitudinal dimension of the form board (115) must have a length corresponding to the longest harness branch to be made on that particular board.

Another drawback of a fully automated system is seen in its initial investment costs. Such costs are not justified, especially where small lots of many different types of harnesses must be manufactured. A semiautomatic system as disclosed herein is substantially more cost-efficient, especially with regard to the initial investment and particularly where small lots of many different types of harnesses must be made.

Yet another drawback of the fully automated system is seen in that its operational speed is limited to the slowest component within the chain of cooperating automatic tools. Thus, the available computer control speed cannot be utilized, for example, by the robot (95) in the system of Bloch et al., because the robot (95) must move its limbs mechanically back and forth.

OBJECTS OF THE INVENTION

In view of the above it is the aim of the invention to achieve the following objects singly or in combination:

to provide a semiautomatic harness finishing system in which the size and the number of harness form boards may be substantially reduced as measured relative to a required manufacturing throughput, thereby simultaneously reducing the required floor space;

to improve the overall efficiency of a conductor wire harness production process or system of the semiautomatic type;

to provide a semi-automatic harness finishing system that assures a satisfactory accuracy of the lengths of the individual conductor wires without requiring the high accuracy necessary for the length and precisely defined position of each individual wire end, which are necessary to make a fully automatic system operable;

to enable the manufacture of conductor wire harnesses substantially of any desired length independently of the dimension of the harness form board by permitting a curved or meandering assembly of the harness, thereby greatly reducing the length of the form board; and to provide a mobile harness carrier which will transport a rolled-up semi-finished conductor wire harness into a cooperating position relative to any one of a plurality of semi-automatic work stations for finishing the semi-finished harness.

SUMMARY OF THE INVENTION

A system for finishing a conductor wire harness by securing contact elements to the ends of conductor wires in a bundle and by inserting secured contact elements into a connector member, comprises, according to the invention, at least one work station for an operator and a mobile harness carrier for holding at least one conductor harness, wherein the harness carrier comprises a platform for supporting the conductor harness, a movable support or carriage for mounting the platform in a rotatable manner and for transporting the platform along a factory floor into a position for cooperation with the work station. This combination of the features achieves the above objects in an economical and floor space saving manner.

The invention also achieves an efficient semi-automatic manufacturing sequence, wherein errors are minimized and the length of the harness does not dictate the size of the harness carrier nor of the form board because the harness is wound onto the rotatable platform which is preferably constructed as a turntable on its own carriage so that the turntable can be transported along the factory floor independently of any of the work station locations.

The work steps that are performed according to the invention involve primarily bringing a platform on its support means or carriage into a cooperation position with the work station where the first step to be performed is the cutting of the individual wires of the bundle forming the harness to a desired length automatically removing the insulation from the wire ends, inserting the conductor wire ends into a contact element, such as a contact pin or a contact bushing, crimping the contact pin or contact bushing to secure the pin or bushing to the wire end, and then inserting the pin or bushing into a connector member which is normally of the female or male plug-in type, preferably held in a clamping device.

The just enumerated work steps are performed semi-automatically by an operator in a computer aided manner with the help of automatic stripping, crimping, and guiding tools which in turn are computer controlled.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
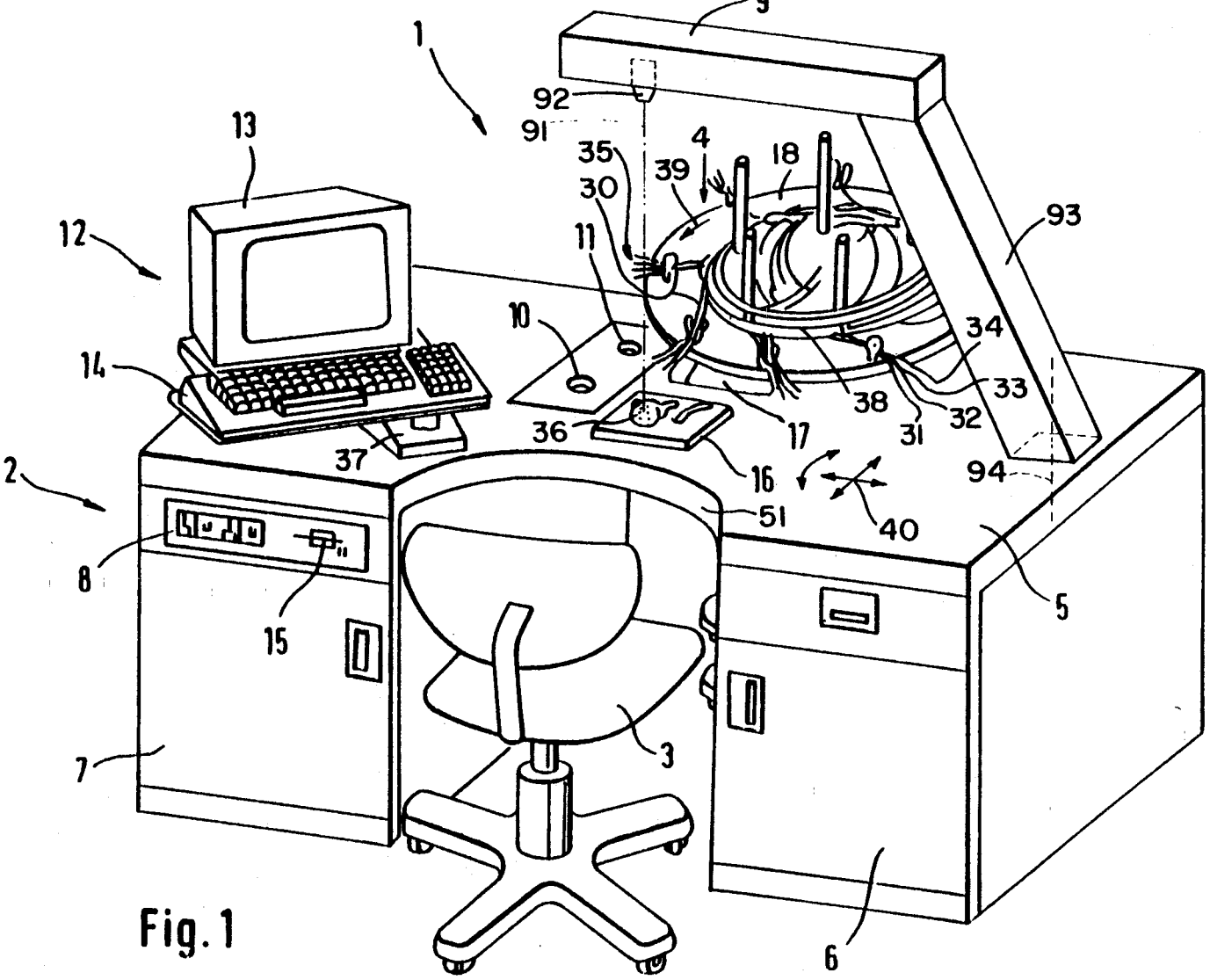
FIG. 1 is a perspective view of a work station according to the invention also showing the harness carrier platform in a position for cooperation with the work station.
Figure 2:
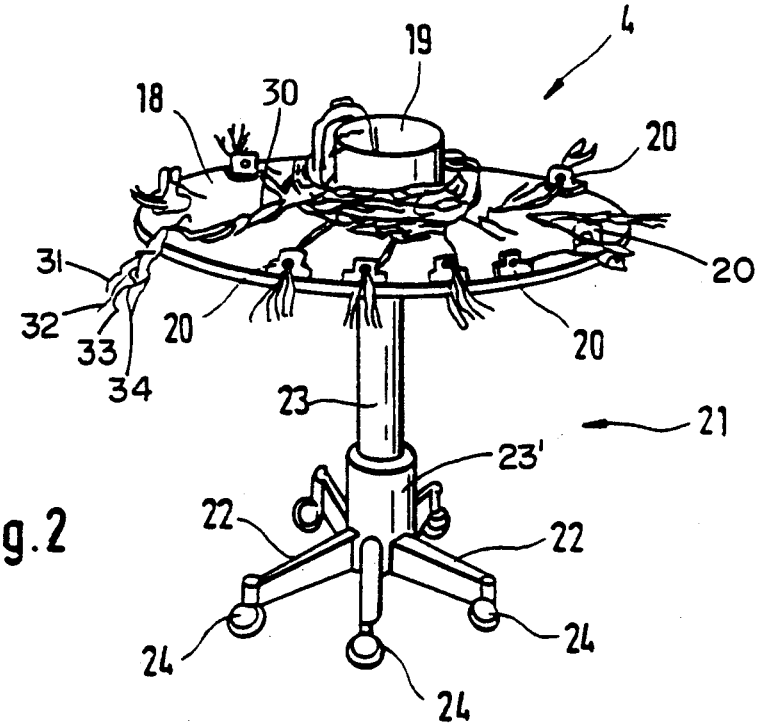
FIG. 2 is a perspective view of one embodiment of a mobile harness carrier according to the invention.
Figure 3:
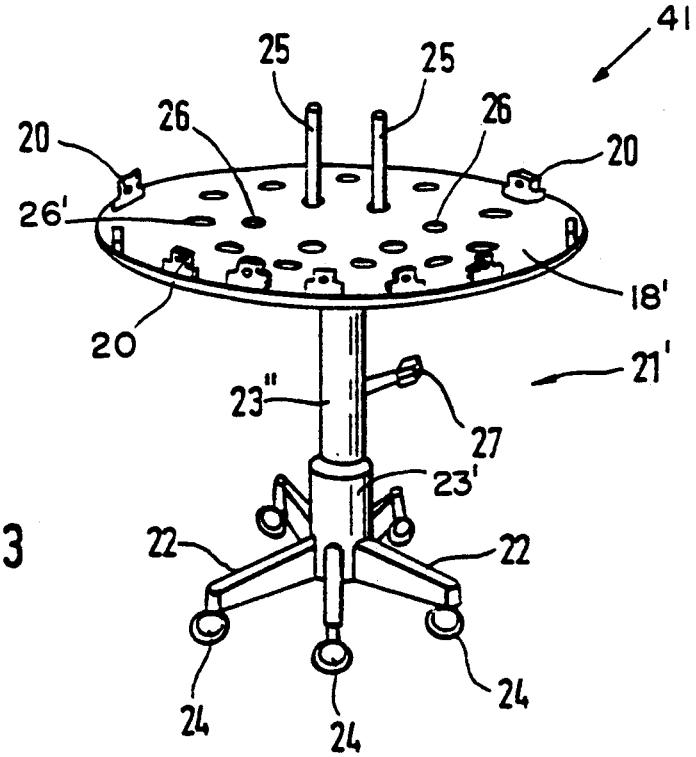
FIG. 3 is a view similar to that of FIG. 2 but showing another embodiment of a harness carrier according to the invention.

FIG. 1 shows an overall system 1 according to the invention for finishing of conductor bundles. The system comprises a work station 2 with a table top 5. The table top 5 has a cut-out 51 for the convenience of an operator sitting on a mobile chair 3. The system further comprises a harness carrier 4 in a rotatable platform 18 to be described in more detail below. The platform is mounted on a column that simultaneously forms a carriage as shown in FIGS. 2 and 3. The column is not shown in FIG. 1, but fits into a recess 17 in the table top 5.

The work station 2 further comprises a storage compartment 6 for tools and small instruments and the like, and an equipment compartment 7 to the left of the operator. Above the equipment compartment there is an operating panel 8 and a disk drive 15. A control computer 12 with a keyboard 14 and a display screen 13 are arranged on a mount 37 on the table top 5. The computer components are preferably arranged to the left of the operator. The computer cooperates with the disk drive 15 which is operable through keys or the like on the operating panel 8.

An automatic insulation removal tool 11 of conventional construction is arranged for access through the table top. Similarly, a conventional automatic crimping tool 10 is arranged for access through the table top. Since the automatic tools 10 and 11 are conventional, they are merely shown symbolically. The table top further carries a clamping device 16 for holding a plug-in connector member 36 in a defined position for the insertion of a contact pin or contact bushing. The insertion is aided by a light beam 91 produced, for example, by a laser generator 92 carried by a support arm 9 mounted by a bracket 93 to the table top 5, preferably in an adjustable manner For this purpose the bracket 93 may rotate relative to the table top about an axis 94 and the arm 9 may similarly pivot relative to the bracket 93.

When the support column of the harness carrier platform 18 is received in the recess 17, the platform 18 is in a proper cooperating position relative to the table top 5 so that the operator may conveniently perform the following steps.

First, the operator grabs the wire ends 31, 32, 33, 34, of a wire bundle 30 of a harness 38 and cuts these wire ends to desired lengths, for example, as shown at 35. Then, each conductor wire end is manually inserted into the stripper tool 11. Thereafter, each wire end is also manually inserted into the contact attachment tool 10. Two steps are performed in this tool 10 automatically. First a contact element, either a contact pin, or a contact bushing, is pushed onto the wire end in accordance with a respective computer aided control of the supply of contact elements. Second, the contact element is crimped to mechanically secure the contact element to the wire end. Thereafter, the respective contact element is inserted into a connector member 36 held in place by the clamping device 16. The insertion is aided by the laser beam 91 which pinpoints the recess in which the respective contact pin or contact bushing is to be inserted.

FIG. 2 shows one embodiment of the movable harness carrier 4 including a vertical support column 23 to which the platform 18 is secured for rotation. The platform 18 is constructed as a turntable equipped with a winding core 19 on which one or several harnesses 30 are wound for transportation and finishing as described. The column 23 is supported in a bearing 23' to permit the rotation of the turntable 18. The bearing 23' is mounted to a foot 22, which in turn has support rollers 24 to permit the travelling of the harness carrier 4 along a factory floor. The column 23 with its bearing 23' and with its foot 22 and rollers 24 together form the movable support or carriage for the turntable 18.

The winding core 19 is preferably cylindrical and centrally mounted on the turntable 18 for winding the harness 30 around the winding core 19.

According to the invention, the harness 30 is initially assembled on a form board, not shown, but not completed on the form board, so that the latter may remain permanently stationary, since the present harness carrier 4 permits the movement of a harness to a finishing work station as described. Even the conventional form board may be shorter because portions of the harness may meander or curve before the entire harness assembly is completed. In any event, the individual conductor wires are assembled in accordance with the manufacturing instructions, whereby protective envelopes, as well as tie wrappers may be applied to form bundles 30.

When the harness is assembled, it is completely wound up and placed on the core 19, so that the completing work steps as described above may be performed in the work station 1. For this purpose the harness coil 38 is placed onto the core 19 on the turntable 18 and the further work can be performed when the column 23 is shifted into the recess 17 of the table top 5 in the work station 1. At this time, the individual branches of the harness are secured in the clamps 20. The above described finishing steps are then performed in the sequence as described, whereby the turntable 18 may preferably be rotated by the operator as needed, for example, in the counterclockwise direction, as indicated by the arrow 39 in FIG. 1. The above mentioned steps of stripping, contact element attachment, crimping, insertion of the contact elements into a connector member 36, are performed in a semiautomatic manner under substantial control of the computer 12.

The stripper 11 receives its digital control signals from the computer 12 in a conventional manner. For this purpose, the computer 12 is equipped with data banks or memories which contain all the data relevant for the work station and relating to the particular harness 38 to be finished. Prior to beginning the finishing operation, the operator operates the keyboard 14 for calling up the data relating to the particular type of harness presently being finished. Then the identity of that harness is inputted through the keyboard 14. Thereafter, the computer displays on its screen 13 a menu in which all the conductor ends 31, 32, 33, 34 etc. of the particular harness are listed. The operator is now able to select from such menu the control signals that relate to the individual conductors or rather conductor ends by pushing the respective key on the keyboard. As soon as the above mentioned cutting operation for bringing the conductor ends to the required length is completed, the insulation stripping, contact insertion, and crimping are performed. For this purpose the operator selects a wire end and reads the marking that the wire end is already carrying. The operator then selects this conductor wire from the menu through the respective keyboard to produce the corresponding control signals for activating the stripping automat and the crimping automat. Now the respective wire end can be introduced into the opening 11 and then into the opening 10 in sequence. When the wire end is fully inserted, a limit switch is contacted, which starts the insulation stripping operation through a respective control circuit which activates a stripper in accordance with the correct control signal individually provided by the computer 12. Each conductor wire end is stripped of its insulation with due regard to its individual wire dimensions. Thus, it is avoided, that cuts deeper than the thickness of the insulation are made on the individual conductor wire. This operation takes place with high precision due to the respective computer control signal, so that damages to the conductor wire by the stripping knife are avoided. When a wire end has been stripped of its insulation as just described, the respective wire end is then inserted by the operator in the opening 10 of the crimping automat. Here again, the insertion activates a sensor switch which in turn produces the respective signal when the wire end is completely inserted into the respective sensor opening. First, the wire end is provided with a contact pin or a contact bushing in accordance with the control signal from the computer 12. Then the crimping step is performed. For this purpose the work station 1 contains a magazine which holds contact pins and contact bushings or any other type of cable terminal. The contact magazine cooperates with the crimping automat 11 through a contact element supply guide which is also responsive to the program control signals from the computer in accordance with the manufacturing data stored in the memory of the computer and relevant for the wire end that has just been stripped of its insulation. As soon as each wire end 31, 32, and so forth of the entire harness has been provided with its contact element, this operation is completed. As has been mentioned above, the turntable 18 can be rotated by the operator as required for reaching each and every conductor wire end.

Rather than providing in the crimping automat a limit switch which generates a signal when the stripped wire end has been fully inserted into its contact element, it is possible to use a light barrier switch to perform the same function. For this purpose the light beam that forms the light barrier is so directed that the light barrier is interrupted when the conductor wire insulation edge that has been formed as part of the stripping operation contacts the respective end of the contact element. The advantage of a light barrier switch, as compared to a limit switch, is seen in that the light barrier is not subject to frictional forces. Thus, the light barrier is preferred, especially for larger conductor wire diameters. Thus, any premature signal generation due to friction is avoided and the crimping operation is triggered when the stripped conductor end is properly inserted into its contact element such as a contact pin or contact bushing or the like.

For aiding the insertion of the contact elements into the connector member 36, the latter is clamped in the clamping device 16 on the table top 5. The device 16 is adjusted in its position to bring the connector member 36 into a proper location relative to the guide beam 91. In this position the connector member 36 faces with its insertion end, that is with its cable facing end, upwardly to facilitate the insertion of the contact pins or contact bushings into the correct chambers of the connector member 36. The clamping device 16 is adjustable in its position as indicated by the arrows 40 relative to the surface of the table top 5 so that each chamber in the connector member 36 may be brought into proper alignment with the guide beam 91. This adjustment of the clamping device 16 is accomplished in response to the control by the computer 12. The clamping device 16 may be fixed in any adjusted position by conventional means, such as a solenoid operated pin or the like. Alternatively, the laser generator 92 may be movable to move the beam 91.

For the proper positioning and alignment of the device 16 or beam 91, the operator enters through the keyboard 14 an identity code of the particular conductor wire end, into the computer 12. The computer then causes the laser generator 92 to produce simultaneously two guide beams 91 which are correlated to determined contact bores or chambers of the respective connector member 36. The latter is then shifted automatically until the two guide beams are aligned with the two contact chambers or bores at which point the clamping device 16 is fixed in its position. The two laser beams are so spaced from each other that two, and only two, contact bores or chambers can be aligned with the respective beams. Thereafter, the screen 13 displays a menu that contains the identifications of all the wire ends to be secured in the connector member Now the operator can begin inserting the contact elements into the correct chambers or bores of the connector member 36. This insertion is performed as follows.

The operator selects one of the conductor ends and reads the identification for that end. He then looks at the screen 13 which indicates which key must be operated on the keyboard 14 for the respective conductor end. As a result, the computer produces a control signal for the alignment of the laser beam 91 with the respective contact chamber in the connector member 36 or vice versa. The operator can now insert the contact pin or contact bushing into the chamber or bore that is marked by the laser beam 91. One and only one chamber is now marked by the laser beam 91 so that an insertion into a wrong chamber is avoided. This reading of the identification is now repeated for each wire end, the respective key, as read from the screen, is operated, and the laser beam travels from chamber to chamber until all contact elements have been inserted into their proper chambers in the connector member 36. This operation is repeated until all conductor ends with their contact elements are inserted into respective connector chambers. This sequence of operational steps is possible because the computer 12 has access to data in its memory from which the computer can read out the coordinates of the respective relevant contact identifications so that the computer is able to convert this stored information into control signals for controlling the laser generator 92 and thus the pinpointing position of the laser guide beam 91 or of the device 16.

It is possible to connect to the computer 12 a handheld, so-called "mouse" for controlling the movement of a cursor on the screen 13. The cursor can be used to mark the various options displayed on the screen. With the aid of the mouse it is no longer necessary to read the screen 13 in order to obtain the information from the menu which key is to be operated on the keyboard 14. The cursor performs this function.

Upon completion of the above described work steps, all conductor wire ends of a conductor bundle or harness are provided with the respective contacts, cable terminals, or connector members, and the harness carrier 4 may be moved to another work station where, for example, some further manual finishing work may be done, such as tie wrapping certain harness branches.

Rather than having the operator read the identification marks from the individual conductor wires, it is possible to read these identifications by an optical reading device which transmits the respective information directly into the computer 12. Such a feature further reduces the source of possible errors.

FIG. 3 shows a modified harness carrier 41 compared to FIG. 2. The modified harness carrier 41 has a turntable 18' rotatably supported by a column 23'' in a bearing 23' as in FIG. 2. In FIG. 3 the cylinder 19 which forms a core for the winding of the harness on the turntable 18, has been replaced by a circle of bores 26 in which core rods 25 are inserted to form the required core. The bores or bushings 26 form a circle and are preferably spaced from one another by uniform angular spacings around the central longitudinal axis of the column 23''. For example, six core rods 25 may be sufficient, especially when these core rods are spaced at uniform angular spacings from one another as mentioned. This type of core facilitates the winding of the harness onto the turntable and it also provides a better over-view as well as a simpler handling. Several circles of bores or bushings may be provided as shown at 26'. In this manner it is possible to provide cores of different diameters by using the same core rods 25 in any of the circles.

Additionally, FIG. 3 permits the vertical adjustment of the turntable 18' by means of a lever 27. Such a structure as such is conventional. With this feature the level of the turntable 18' can be adapted to different types of work stations.

Figure 4:
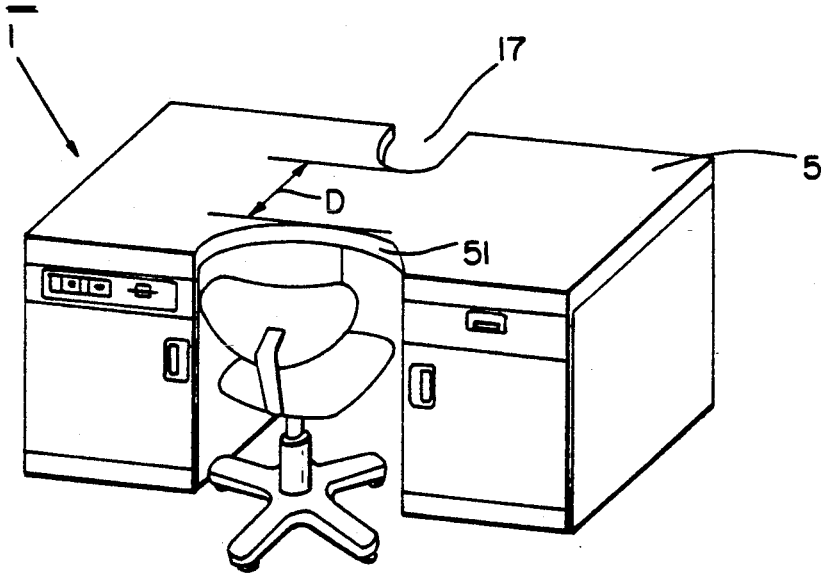
FIG. 4 is a perspective view of the work station showing the features of the table top constructed for the convenience of the operator.

FIG. 4 shows the work station 1 without the equipment illustrated in FIG. 1 on top of the table top 5 so as to illustrate the distance D between the inner edge of the recess 17 that receives the support column 23, 23'' and the inner edge of the cut-out 51. This distance D must be selected with due regard to the reach of an operator so that the latter may conveniently reach the individual conductor wire ends. The distance D will be selected based on practical experience.

Although the invention has been described with reference to specific example embodiments, it will be appreciated that it is intended to cover all modifications and equivalents within the scope of the appended claims.

What I claim is:

1. A system for finishing a conductor wire harness, comprising at least one work station for an operator, said work station including work performing means for securing contact elements to ends of conductors in a bundle and means for inserting secured contact elements into a connector member, and a harness carrier for holding at least one conductor harness, said harness carrier comprising a platform for supporting a conductor harness, and movable support means on which said platform means is mounted in a rotatable manner and for transporting said platform along a floor into a position for cooperation with said work station, said work station comprising a recess into which said support means are movable for bringing said platform into said position for cooperation with said work performing means of said work station.

2. The system of claim 1, wherein said work performing means of said work station comprises a computer for coordinating and working operations, an insulation stripper, a crimper, a computer controlled guide beam device for indicating to an operator a spot where a contact element is to be inserted into a connector member, and a clamping device for positioning said connector member on said platform means.

3. The system of claim 1, work said work station further comprises a cut-out for an operator to reach said conductor ends for performing work steps on said conductor ends.

4. The system of claim 3, wherein said recess and said cut-out are positioned opposite each other in a table top of said work station.

5. The system of claim 1, wherein said movable support means of said platform means comprises a vertical column, means for operatively securing said platform means to said vertical column, a foot to which said column is secured, and roller means secured to said foot for transporting said platform means on its column into said position for cooperation.

6. The system of claim 5, wherein said platform means is a turntable which is rotatable about a vertical axis of said column.

7. The system of claim 1, further comprising a substantially cylindrical winding core on said platform means for winding a wire harness around said winding core.

8. The system of claim 7, wherein said substantially cylindrical winding core comprises a plurality of vertical core rods, said platform means comprising a number of bores for holding said core rods, and wherein said bores are arranged in at least one circle on said platform means for forming said substantially cylindrical winding core.

9. The system of claim 8, wherein said bores are arranged along at least two concentric circles so that substantially cylindrical winding cores of two different diameters can be formed by inserting said core rods into bores of one or the other circle of bores.

10. The system of claim 8, wherein said rods are inserted at uniform angular spacings from one another.

11. The system of claim 9, wherein said bores are sockets in said platform means.

12. The system of claim 5, wherein said vertical column comprises means for adjusting a vertical position of said platform means 13. The system of claim 1, further comprising a plurality of clamping members on said platform means for holding individual conductor wires of said harness in position 14. The system of claim 13, wherein said clamping members are angularly spaced from each other near a circumference of said platform means.

15. The system of claim 2, wherein said work performing means are arranged in or on a table top of said work station in a sequence corresponding to the sequence of work steps: insulation removal, contact element attachment, crimping, and insertion of crimped contact elements into said connector member.

* * * * *

UNITED STATES PATENT AND TRADEMARK OFFICE

CERTIFICATE OF CORRECTION

PATENT NO. : 5,179,775

DATED : January 19, 1993

INVENTOR(S) : Hans Bogotzek et al.

It is certified that error appears in the above-identified patent and that said Letters Patent is hereby corrected as shown below:

In [57] Abstract, line 4, replace "connnector" by --connector--;
Column 9, line 3, replace "work" (1st occurrence) by --wherein--
Column 10, line 18, after "position" insert --.--.

Signed and Sealed this

Second Day of November, 1993

Bruce Lehman

*Attest:*

BRUCE LEHMAN

*Attesting Officer*

*Commissioner of Patents and Trademarks*